United States Patent [19]

Hart

[11] Patent Number: 4,826,072

[45] Date of Patent: May 2, 1989

[54] MICROWAVE CARTON

[75] Inventor: Joseph J. Hart, Philadelphia, Pa.

[73] Assignee: Container Corporation of America, Clayton, Mo.

[21] Appl. No.: 148,605

[22] Filed: Jan. 26, 1988

[51] Int. Cl.[4] ..... B65D 81/34

[52] U.S. Cl. ..... 229/104; 229/120; 229/903; 229/DIG. 14; 426/109; 426/114

[58] Field of Search ..... 229/104, 112, 120, 126, 229/160, 163, 169, 186, 902, 903, 906, DIG. 14; 219/10.55 E; 426/107, 109, 113, 114

[56] References Cited

U.S. PATENT DOCUMENTS

| | | | |
|---|---|---|---|
| 1,407,688 | 2/1922 | Banton | 229/DIG. 14 |
| 1,513,608 | 10/1924 | Labombarde | 229/104 |
| 1,948,083 | 2/1934 | Warner | 229/104 |
| 2,749,019 | 6/1956 | Ohlund | 229/126 |
| 2,907,510 | 10/1959 | Vines | 229/104 |
| 3,088,650 | 5/1963 | Leukoff | 229/104 |
| 3,178,242 | 4/1965 | Ellis et al. | 229/104 |
| 3,703,256 | 11/1972 | Ross | 229/110 |
| 4,096,948 | 6/1978 | Kuchenbecker | 229/104 |
| 4,190,757 | 2/1980 | Turpin et al. | 219/10.55 E |
| 4,260,060 | 4/1981 | Faller | 229/104 |
| 4,291,806 | 9/1981 | Austin | 229/DIG. 14 |
| 4,355,757 | 10/1982 | Roccatorte | 229/DIG. 14 |
| 4,538,732 | 9/1985 | Kuchenbecker | 229/104 |
| 4,584,202 | 4/1986 | Roccaforte | 426/113 |

*Primary Examiner*—David T. Fidei
*Assistant Examiner*—Gary E. Elkins
*Attorney, Agent, or Firm*—Richard W. Carpenter

[57] ABSTRACT

A disposable, collapsible, sleeve-type, microwave carton, formed from a unitary blank of foldable paperboard, at least partly coated with electrically conductive material, and comprising top, bottom, side and end walls foldably joined to each other, with the bottom wall being elevated above the surface on which the carton is supported by legs extending downwardly below the bottom wall.

7 Claims, 2 Drawing Sheets

MICROWAVE CARTON

BACKGROUND OF THE INVENTION

1. Field of the Invention

This invention relates to food packaging, and primarily to a paperboard carton adapted for holding an item of food and assisting in the browning of the surface of the food item in a microwave oven.

2. Description of the Background Art

A background art search directed to the subject matter of the present invention conducted in the United States Patent and Trademark Office disclosed the following U.S. Pat. Nos.:

4,638,941, 4,612,431, 4,592,914, 4,574,174, 4,355,757, 4,283,427, 4,279,374, 4,260,060, 4,228,945, 4,136,817, 4,096,948.

None of the patents uncovered in the search discloses a disposable, collapsible, sleeve-type, paperboard carton which is partially coated with electrically conductive material and which comprises top, bottom, side and end walls foldably joined to each other, with the bottom wall being elevated above the surface on which the carton is supported by legs extending downwardly below the bottom wall.

SUMMARY OF THE INVENTION

It is an object of the present invention to provide a sleeve type, paperboard folding carton adapted to hold an article of food and to assist in browning the outer surface of the food when subjected to microwave radiation in a microwave oven.

Another object of the invention is the provision of a microwave carton that is adapted to support a product being heated in a microwave oven, which carton may be used either as an inner carton, with an overwrap or outer carton, or which may be inserted into a package with another carton that actually holds the product.

A more specific object of the invention is the provision of a sleeve-type, paperboard, microwave carton having top, bottom, side and end walls and means for supporting the carton in such a manner that the bottom wall is elevated from the surface upon which the carton is supported.

These and other objects of the invntion will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
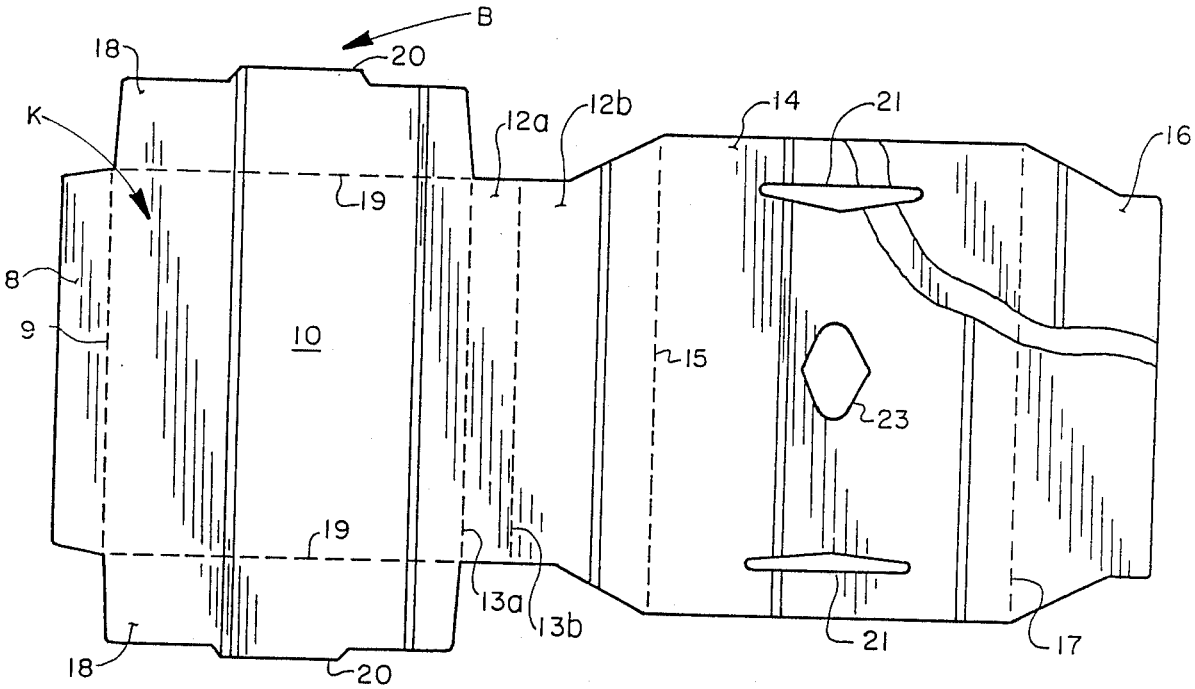
FIG. 1 is a plan view of a blank of foldable paperboard which may be used to form the carton illustrated in other views.

Referring now to the drawings for a better understanding of the invention, it will be seen that the novel carton embodying features of the invention, and indicated generally at C in FIGS. 2–5, may be formed from a unitary blank B of foldable sheet material, such as paperboard, illustrated in FIG. 1.

As previously mentioned, the purpose of the carton is to support an article of food while the food is being heated in a microwave oven and to assist in the browning of the surface of the food.

The carton also may be used to enclose the article of food when it is initially packaged, or it may be provided as a separate carton included in a package with another carton that actually holds the food product.

As best seen in FIG. 1, the body of the carton includes a second side wall inner panel 8, a bottom wall panel 10, a first side wall inner panel **12*a*, a first side wall outer panel 12*b*, a top wall panel 14, and a second side wall outer panel 16, which are foldably joined to each other along fold lines 9, 13*a*, 13*b*, 15, and 17, respectively. The carton also includes a pair of end wall panels 18 which are foldably joined along fold lines 19 to opposite end edges of bottom wall panel 10**.

Figure 2:
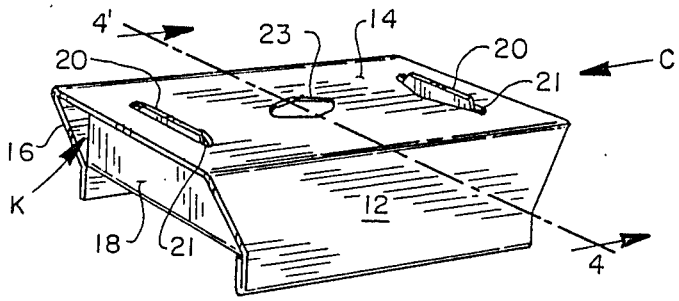
FIG. 2 is a fragmentary perspective view of a carton embodying features of the invention, as shown in its normal upright position.

As best seen in FIG. 2, when the carton is in erected position the top, bottom, and side walls form a tubular structure open at the ends. Also, the side wall inner panels 8 and **12*a* are disposed against and secured to the inner surfaces of outer side wall panels 16 and 12*b*, respectively, and portions of each of the side walls 12 and 16 project downwardly below bottom wall 10**.

The ends of the tubular structure are closed by the end walls 18 which are foldably joined to the end edges of the bottom wall and which extend upwardly toward top wall 14.

Figure 3:
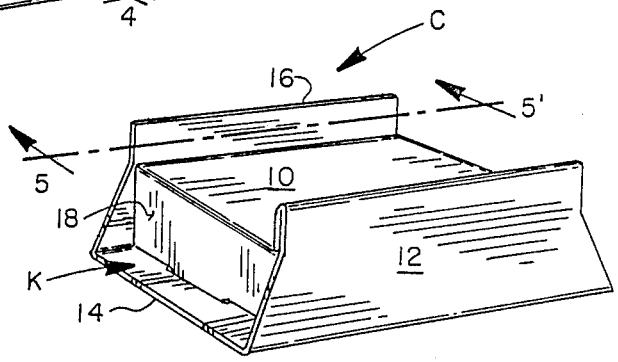
FIG. 3 is a view similar to FIG. 2, but showing the carton in an inverted or upside down position.
Figure 4:
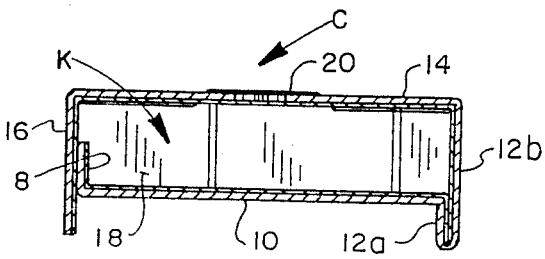
FIGS. 4 and 5 are transverse and longitudinal vertical sectional views taken on lines 4—4 and 5—5 of FIGS. 2 and 3, respectively.
Figure 5:
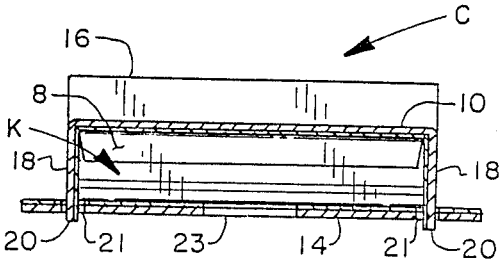
Figure 6:
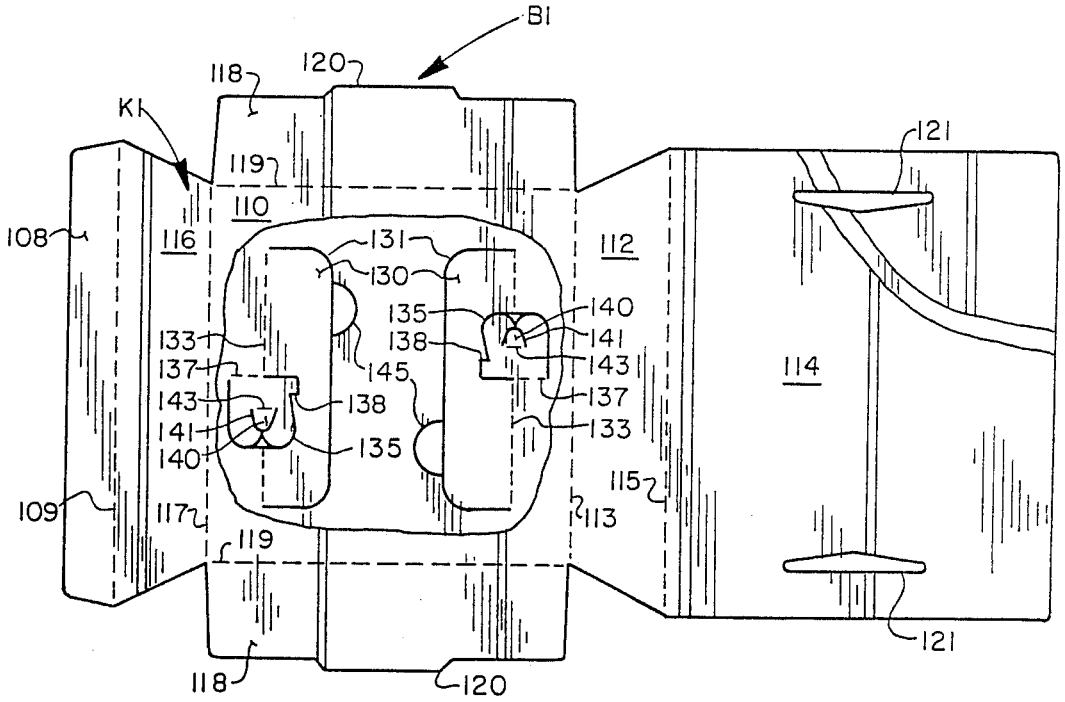
FIGS. 6–10 are views similar to those of FIGS. 1–5, but illustrate a modified form of the invention.
Figure 7:
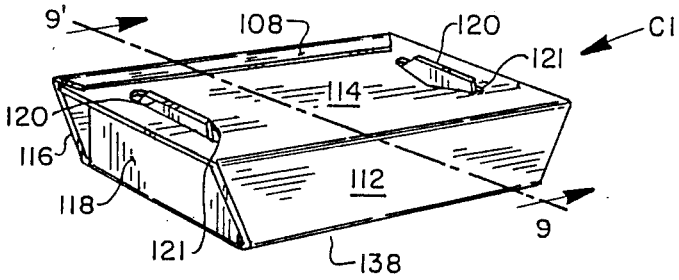

Each of the end walls 18 may be provided with a projection 20 which is disposed to extend through a related opening 21 in top wall 14 adjacent a related end thereof. As best seen in FIGS. 2 and 3, the top wall is of the same width as, but slightly longer than bottom wall 10 of the carton.

In order to provide venting, one or more vent openings 23 may be provided in the top wall of the carton. If desired, additional vent openings may be provided in other carton walls.

At least one surface of one of the walls of the carton is coated with a preferably discontinuous layer of electrically conductive material indicated generally at K. The coating K, which assists in browning the food surface, may be either on the inner or outer surface of the carton.

The specific details of the coating K are not included in this application, as they are more fully described in co-pending patent application: Ser. No. 121,031, filed Nov. 16, 1987 in the names of Joseph J. Hart, David C. Glasgow, and Richard W. Carpenter, as co-inventors.

To erect the carton from a collapsed condition, it is folded into a tubular structure with the end walls 18 folded at right angles to the bottom wall and with the lock tabs 20 being inserted through the openings 21 at the opposite ends of the top wall 14.

When the carton holding an article of food is placed in a microwave oven, the coating K serves to assist in browning the outer surface of the article of food. It should be noted that the article of food may be placed either within the carton, or on top of the upper wall of the carton as desired.

Turning now to FIGS. 6–10 of the drawings, it will be seen that a slightly modified form of the invention is shown. In this embodiment, portions of the structure which correspond to portions of the structure of the previously described embodiment are identified by related numerals.

In the embodiment illustrated in FIGS. 6–10, the side walls 112 and 116 extend between the top and bottom walls 110 and 114, but not beyond the top or bottom wall.

The carton of this embodiment is elevated from the surface upon which the carton is supported by means of a pair of support panels 130 which are formed from material of bottom wall panel 110 and foldably joined thereto along fold lines 133. The support panels are spaced from each other and are defined by cut line 131 and the previously mentioned fold lines 133.

In order to maintain the support panels in supporting position, that is folded normal to bottom wall panel 110, there are provided a pair of retaining panels 134 which are also formed from material of bottom wall panel 110, including portions of the material used to form the support panels 130. Each retaining panel 134 is defined by a cut line 135 and a fold line 137.

It will be seen that support panels 130 each include a shoulder 138 which extends into the opening formed when the related retaining panel 134 is folded out of the plane of the support panel and normal thereto.

Figure 8:
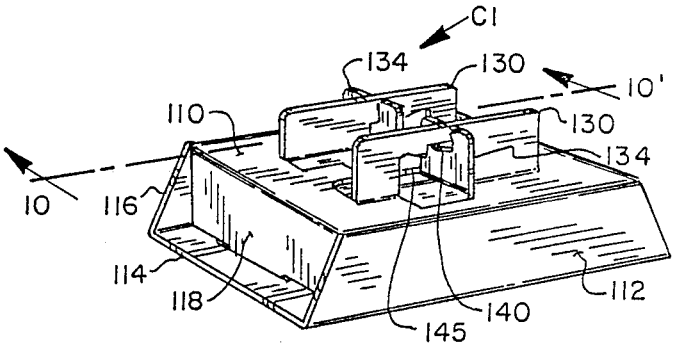
Figure 9:
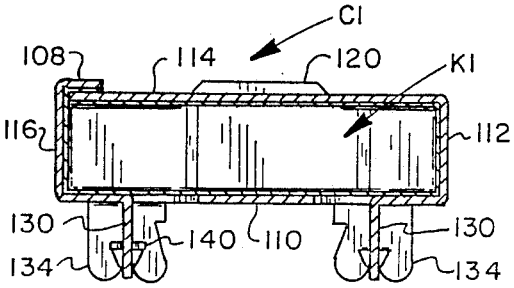
Figure 10:
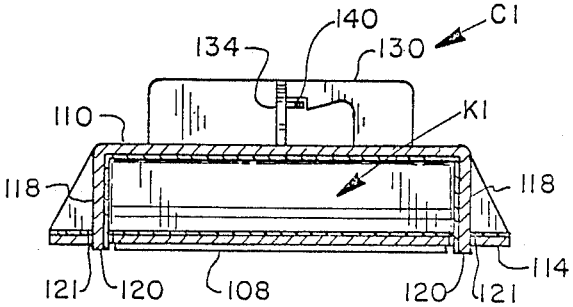

There is also formed from material of each of the retaining panels 134 a lock tab 140 which is defined by a cut line 141 and a fold line 143. The purpose of the lock tab is to afford interlocking engagement between the support panel and related retaining panel, as best seen in FIG. 8.

Bottom wall 110 may be provided with a pair of finger openings 145 located adjacent support panels 130 to facilitate grasping the panels.

Thus, it will be appreciated that in each embodiment of the invention there is provided a sleeve-type, paperboard carton for holding or supporting food in a microwave oven which carton includes means for elevating the bottom wall of the carton from a surface from which it is supported.

What is claimed is:

1. A disposable, collapsible, sleeve-type carton, coated on at least one surface thereof with electrically conductive material and adapted to hold an item of food for browning a surface thereof when subjected to microwave radiation, said carton being formed from a unitary blank of foldable paperboard and comprising:

(a) top and bottom major walls foldably joined to each other by opposed side walls to form a tubular structure open at the ends;

(b) certain of said bottom and side walls having portions extending downwardly below said bottom wall to elevate said bottom wall above a surface on which said carton is supported;

(c) a pair of end walls foldably joined to respective end edges of one of said major walls and extending to the other of said major walls to close the ends of said tubular structure;

(d) each of said end walls having, projecting from a free upper edge thereof, a lock tab disposed to extend through an opening in said other major wall adjacent a related end thereof;

(e) at least one of said walls having a vent opening extending therethrough;

(f) said downwardly extending portions including a pair of support panels formed from material of said bottom wall and folded downwardly therefrom and normal thereto;

(g) at least one retaining panel formed from material of said bottom panel and folded downwardly therefrom and normal thereto for interlocking engagement with at least one of said support panels.

2. A carton according to claim 1, wherein said bottom wall is of the same width as but slightly shorter than said top wall.

3. A carton according to claim 1, wherein said top wall has at least one vent opening extending therethrough.

4. A carton according to claim 1, wherein said end walls are foldably joined to opposite end edges of said bottom wall and extend upwardly to said top wall.

5. A disposable, collapsible, sleeve-type carton, coated on at least one surface thereof with electrically conductive material and adapted to hold an item of food for browning a surface thereof when subjected to microwave radiation, said carton being formed from a unitary blank of foldable paperboard and comprising:

(a) top and bottom major walls foldably joined to each other by opposed side walls to form a tubular structure open at the ends;

(b) certain of said bottom and side walls having portions extending downwardly below said bottom wall to elevate said bottom wall above a surface on which said carton is supported;

(c) a pair of end walls foldably joined to respective end edges of one of said major walls and extending to the other of said major walls to close the ends of said tubular structure;

(d) each of said end walls having, projecting from a free upper edge thereof, a lock tab disposed to extend through an opening in said other major wall adjacent a related end thereof;

(e) at least one of said walls having a vent opening extending therethrough;

(f) said downwardly extending portions including a pair of support panels formed from material of said bottom wall and folded downwardly therefrom and normal thereto;

(g) a pair of retaining panels formed from material of said bottom wall and folded downwardly therefrom and normal thereto for engagement with respective support panels to maintain them in supporting position.

6. A disposable, collapsible, sleeve-type carton, coated on at least one surface thereof with electrically conductive material and adapted to hold an item of food for browning a surface thereof when subjectd to microwave radiation, said carton being formed from a unitary blank of foldable paperboard and comprising:

(a) top and bottom major walls foldably joined to each other by opposed side walls to form a tubular structure open at the ends;

(b) certain of said bottom and side walls having portions extending downwardly below said bottom wall to elevate said bottom wall above a surface on which said carton is supported;

(c) a pair of end walls foldably joined to respective end edges of one of said major walls and extending to the other of said major walls to close the ends of said tubular structure;

(d) each of said end walls having, projecting from a free upper edge thereof, a lock tab disposed to extend through an opening in said other major wall adjacent a related end thereof;

(e) at least one of said walls having a vent opening extending therethrough;

(f) said downwardly extending portions including a pair of support panels formed from material of said bottom wall and folded downwardly therefrom and normal thereto;

(g) a pair of retaining panels formed from material of said bottom wall and folded downwardly therefrom and normal thereto for engagement with respective support panels to maintain them in supporting position;

(h) said retaining panels being disposed normal to said support panels.

7. A disposable, collapsible, sleeve-type carton, coated on at least one surface thereof with electrically conductive material and adapted to hold an item of food for browning a surface thereof when subjected to microwave radiation, said carton being formed from a unitary blank of foldable paperboard and comprising:

(a) top and bottom major walls foldably joined to each other by opposed side walls to form a tubular structure open at the ends;

(b) certain of said bottom and side walls having portions extending downwardly below said bottom wall to elevate said bottom wall above a surface on which said carton is supported;

(c) a pair of end walls foldably joined to respective end edges of one of said major walls and extending to the other of said major walls to close the ends of said tubular structure;

(d) each of said end walls having, projecting from a free upper edge thereof, a lock tab disposed to extend through an opening in said other major wall adjacent a related end thereof;

(e) at least one of said walls having a vent opening extending therethrough;

(f) said downwardly extending portions including a pair of support panels formed from material of said bottom wall and folded downwardly therefrom and normal thereto;

(g) a pair of retaining panels formed from material of said bottom wall and folded downwardly therefrom and normal thereto for engagement with respective support panels to maintain them in supporting position;

(h) a lock tab formed from material of a retaining panel and folded normal thereto for interlocking engagement with a related support panel.

* * * * *